United States Patent [19]

Giori

[11] Patent Number: 4,574,696

[45] Date of Patent: Mar. 11, 1986

[54] ROTARY PRESS FOR THE SIMULTANEOUS MULTICOLOR PRINTING ON BOTH SIDES OF A WEB OR SHEET

[75] Inventor: Gualtiero Giori, Lonay, Switzerland

[73] Assignee: De La Rue Giori S.A., Switzerland

[21] Appl. No.: 622,986

[22] Filed: Jun. 21, 1984

[30] Foreign Application Priority Data

Jul. 26, 1983 [CH] Switzerland ..... 4085/83

[51] Int. Cl.[4] ..... B41F 5/16

[52] U.S. Cl. ..... 101/152; 101/177; 101/179

[58] Field of Search ..... 101/152, 153, 177, 174, 101/179, DIG. 22, 175

[56] References Cited

U.S. PATENT DOCUMENTS

| | | | |
|---|---|---|---|
| 2,853,003 | 9/1958 | Kaldschmidt et al. | 101/152 X |
| 3,390,631 | 7/1968 | Koszul | 101/155 |
| 4,421,027 | 12/1983 | Fischer | 101/179 X |
| 4,441,423 | 4/1984 | Germann | 101/177 X |

FOREIGN PATENT DOCUMENTS

| | | | |
|---|---|---|---|
| 641543 | 5/1962 | Canada | 101/152 |
| 0091709 | 10/1983 | European Pat. Off. | 101/152 |
| 0092887 | 11/1983 | European Pat. Off. | 101/175 |
| 2094717 | 9/1982 | United Kingdom | 101/177 |
| 2094715 | 9/1982 | United Kingdom | 101/177 |
| 2096058 | 10/1982 | United Kingdom | 101/177 |

*Primary Examiner*—Clifford D. Crowder

*Attorney, Agent, or Firm*—Kane, Dalsimer, Kane, Sullivan and Kurucz

[57] ABSTRACT

The machine can print on one of the paper sides an image with juxtaposed colors by means of a typographic plate cylinder inked by a collecting cylinder inked in turn by selective color inking cylinders of which the number corresponds to the number of colors, and on the other side an image with superposed colors and designs by means of offset plate cylinders contacting an offset blanket cylinder and of which the number corresponds to the number of colors and designs of this image. For this purpose the machine comprises another blanket cylinder contacting the typographic plate cylinder and pressed against the offset blanket cylinder, the paper passes between this cylinder and the other blanket cylinder. The multicolor printing on the side receiving the image with juxtaposed colors may be completed by a monochrome wet offset print.

3 Claims, 2 Drawing Figures

ROTARY PRESS FOR THE SIMULTANEOUS MULTICOLOR PRINTING ON BOTH SIDES OF A WEB OR SHEET

FIELD OF INVENTION

The invention relates to a rotary press for the simultaneous multicolor printing of both sides of a web or sheet.

PRIOR ART

A machine is already known through the U.S. Pat. No. 4,441,423 which performs on one side of the paper the printing of an image with juxtaposed colors. This image is printed by means of a single typographic printing plate representing the complete design to be printed and mounted on a plate cylinder. This typographic plate is inked by a collecting device consisting of a blanket cylinder inked in turn by a plurality of selective color inking cylinders of which the number corresponds to the image to be printed. Each selective inking cylinder comprises relief cut areas representing the image portions to be colored in a predetermined color transferred thereto by its inherent inking device. This machine is intended notably for printing the safety background of bank notes.

With this method, currently referred to as the "Orlof" or color collecting printing method, a multicolor image is obtained which ensures a perfect registration between the different colors of the image design, a result that cannot be obtained with any other printing method. Since the selective color inking cylinders are in contact with a resilient surface of the collecting cylinder, they can be manufactured from hard material so that areas having a very fine relief, and therefore very fine colored portions, for example in one form of lines or points, can be obtained.

On the other hand, offset or indirect typographic printing with superposed colors and design is also known which, likewise, is frequently utilized for printing safety backgrounds. According to this method, the complete design consists of partial designs in different colors carried by offset printing plates mounted on plate cylinders to permit the superposition of designs and colors registering with one another on a blanket cylinder against which the paper to be printed is pressed. The number of offset printing plates and consequently of plate cylinders corresponds to the number of different colors and designs constituting the multicolor image.

Machines of this type are also known for the simultaneous printing on both sides, wherein the paper passes between two blanket cylinders receiving each a multicolor image from the corresponding offset plate cylinders.

In the present state of the art machines have been developed which exploit separately one or the other of the above-described methods.

SUMMARY OF THE INVENTION

It is the object of this invention to provide a single and same machine combining in a simultaneous recto and verso printing the two above-described methods and referred to hereinafter as the "Orlof" method and the offset method.

To achieve this purpose, the invention is characterized by a machine as disclosed in claim 1.

The advantage of this machine consists in that it permits of exploiting simultaneously two totally different methods for printing in a single pass an offset image on one side and an "Orlof" image on the other side, thus offering the user for the first time the possibility of printing notably safety backgrounds on both sides of a bank note through two different methods; this increases the safety against forgery and in addition makes printing operations more economical because the user is not compelled to resort to two separate machines.

Advantageous forms of embodiment of the inventions are described in the depending claims.

The invention will be described by way of non-limiting example through one form of embodiment and a modified version with reference to the attached drawings.

DESCRIPTION OF THE PREFERRED EMBODIMENTS

Figure 1:
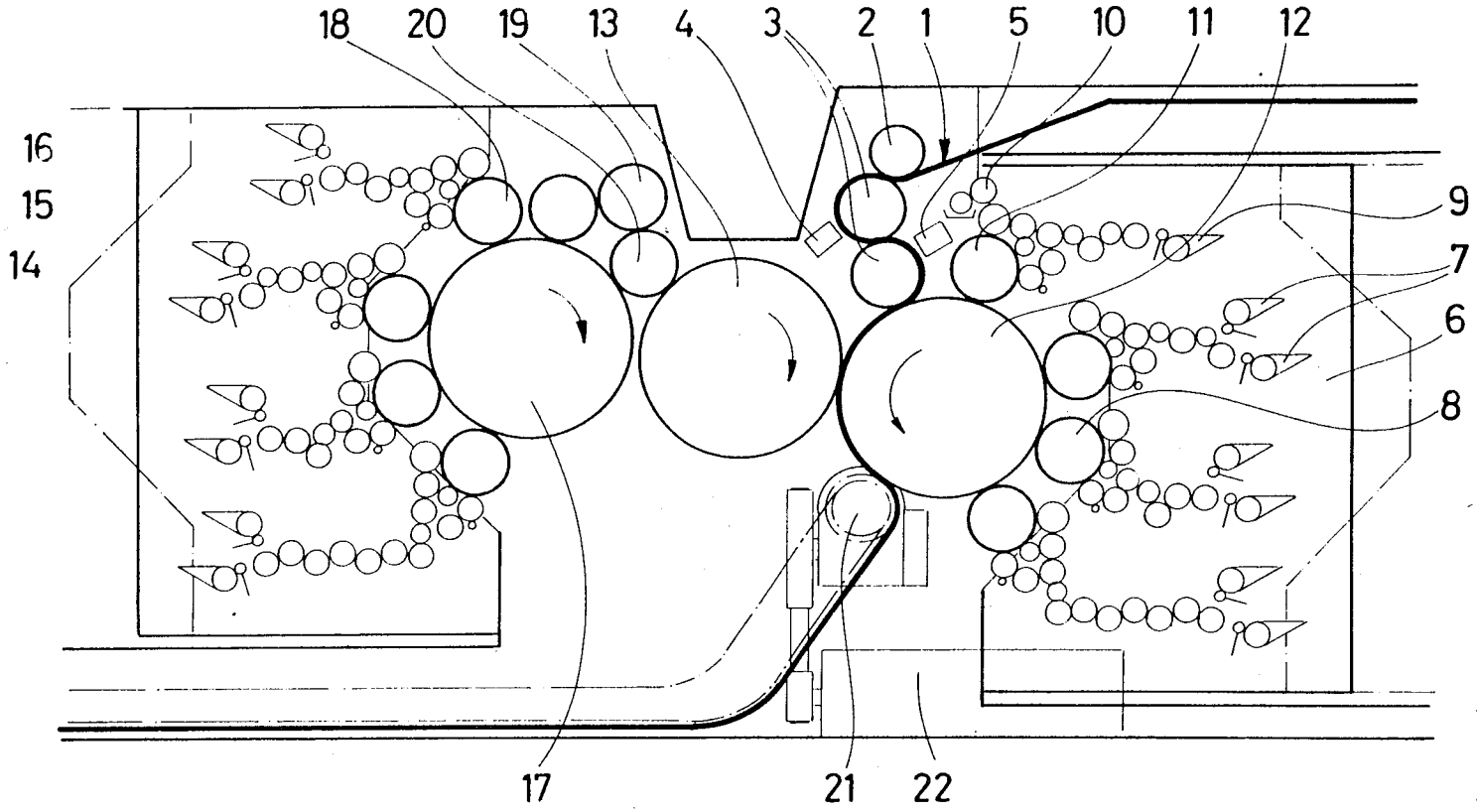
FIG. 1 illustrates diagrammatically a printing machine according to the invention.

The machine illustrated relates to a sheet printing machine and comprises an input device 1 for the paper in sheet form, which is provided with a stop drum 2, two transfer drums 3 provided with grippers, and dedusting and static electricity eliminators 4,5 installed on both sides of the paper 1. The sheets are transferred to a blanket cylinder 12 provided with grippers and pressed against another blanket cylinder 13 of same diameter. The sheets pass between blanket cylinders 12 and 13 and are printed simultaneously on both sides. The cylinders rotate in the direction shown by the arrows. After printing, the sheets are conveyed by a chain gripper system 21 and delivered to output piles or, if necessary, to another machine for completing the printing. The main motor of the machine is designated by reference numeral 22.

The blanket cylinder 12 cooperates according to FIG. 1 with four offset plate cylinders 8 of which three, in the example discussed herein, are each provided with a dry offset printing plate each inked by an inking unit 7 with double ink duct; the fourth offset plate cylinder 11 carries a wet offset printing plate inked by an inking unit 9 with single ink duct provided with a dampening device 10. All these elements 7 to 11 are installed on a movable offset inking carriage 6.

The dry offset printing plates are typographic plates known per se and the wet offset printing plate is an intaglio plate also known per se. These four offset plates represent partial designs which are inked in different colors and their number corresponds to the number of colors and designs of the first image to be printed on one side of paper 1. This image is notably a safety background in the case of fiduciary documents, notably bank notes.

These partial designs in different colors are combined on the blanket cylinder 12 acting as an offset blanket cylinder, therefore as a collecting cylinder for the partial designs constituting the multicolor image. This image is transferred to one side of the paper, in the example concerned on the back side, where a three-color dry offset printing is obtained and completed by a monochrome wet offset printing.

In the case of fiduciary documents one may also use the three dry offset plate cylinders 8 for creating a three-color background, whereas the wet offset plate cylinder 11 represents a main design.

Of course for the offset printing method all the plate cylinders mounted on the movable carriage 6, therefore in the example concerned all the four plate cylinders, can also be provided with dry offset plates.

On the other side of the machine the elements necessary for printing an "Orlof" image are disposed. These elements comprise a blanket cylinder 17 having the same diameter as blanket cylinders 12 and 13. This blanket cylinder 17 cooperates in the example illustrated with four selective color inking cylinders 16 having relief areas cut according to the contours of the areas to be printed in the respective color, they are each inked in this color by means of an inking device 15 with double ink duct. These elements 15,16 are installed on an "Orlof" movable inking carriage 14. These selective cylinders 16 are made preferably of hard material not prone to undergo any distortion even if the relief is very fine, thus permitting of obtaining a safety background consisting of very fine color areas. The areas of the four colors are transferred to the blanket cylinder 17 operating as a collecting cylinder on which they are combined and by which they are transferred to a plate cylinder 20 carrying a typographic printing plate contacting said collecting cylinder and also blanket cylinder 13. This typographic plate represents the complete design of the second image to be printed in four colors on the other side of the paper. The complete image inked in the different colors is transferred in turn to blanket cylinder 13 for applying the printing of the complete image, notably a safety background, to the front side of the paper, of which the back side receives simultaneously the offset image. During the simultaneous printing the two cylinders 12 and 13 act mutually as counter-pressure cylinders.

The machine further comprises a first image transfer cylinder 18 and a second image transfer cylinder 19 both adapted to transfer the same image from the colored areas of blanket cylinder 17 in perfect registration to the typographic plate cylinder 20, thus permitting of reinforcing the inking of the typographic plate in the desired colors and therefore of better covering these areas with the desired ink. In fact, considering the direction of rotation of blanket cylinder 17, one fraction of the ink is transferred by cylinders 18 and 19 to the typographic plate cylinder 20 whereas the remaining fraction of the ink is transferred in perfect registration directly to this cylinder 20. The arrangement of the cylinders involved for obtaining this double inking is known (DE.A No. 3,109,964), the second inking being shifted by the length of the periphery of the typographic plate cylinder 20 or, in the example considered herein, by onethird of the periphery of blanket cylinder 17 because the latter has a diameter three times greater than the diameter of cylinder 20 and carries three blankets.

To meet this registration requirement, the arrangement of cylinders 17,18,19 and 20 is such that the sum of the arc lengths measured on the peripheries of cylinders 18,19 and 20 between the respective points of contact—as seen in the direction of rotation of these cylinders—must be equal to the arc length measured on the periphery of cylinder 17 between the points of contact of this cylinder with cylinders 18 and 20, plus ⅓rd of the periphery of this cylinder 17.

If the design carried by the typographic plate for the "Orlof" printing consists only of lines, therefore of very narrow inked areas, the image transfer cylinders 18 and 19 may be dispensed with and merely a single inking of the "Orlof" typographic plate may be accomplished.

In the example illustrated the ratio of the diameters of cylinders 8,11,16,18,19 and 20, on the one hand, to the diameters of cylinders 12,13 and 17, on the other hand, is 1:3; therefore, since the periphery of cylinders 12,13 and 17 corresponds to three papers sheets, these cylinders carry each three blanket.

Figure 2:
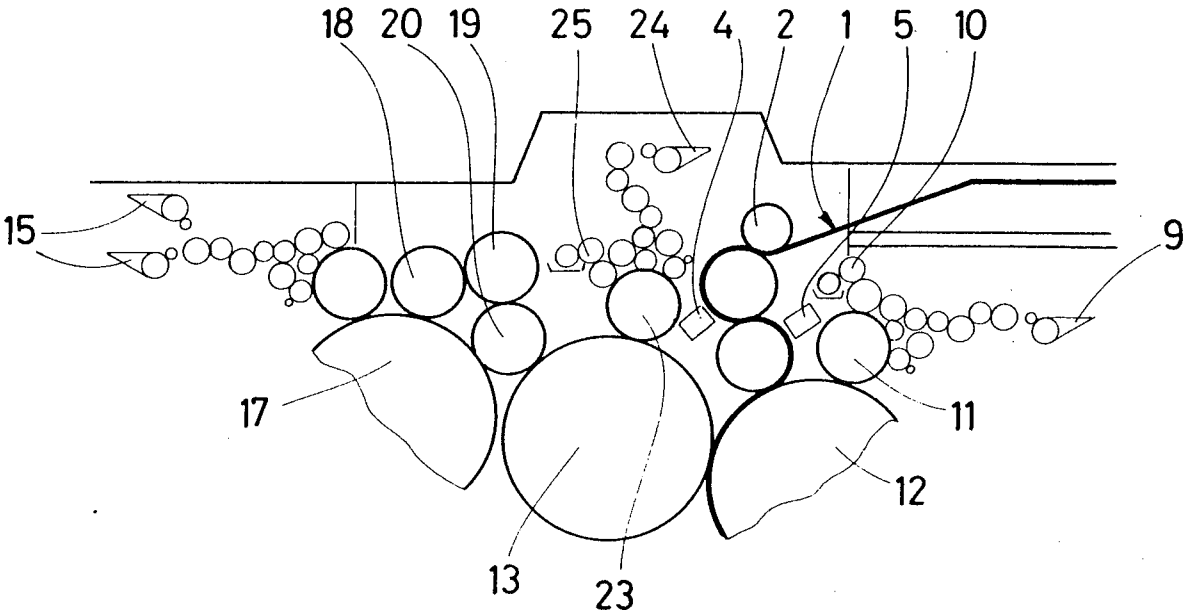
FIG. 2 illustrates diagrammatically, in fragmentary view, an extension of this machinè completed by another wet offset printing unit.
Figure 1:
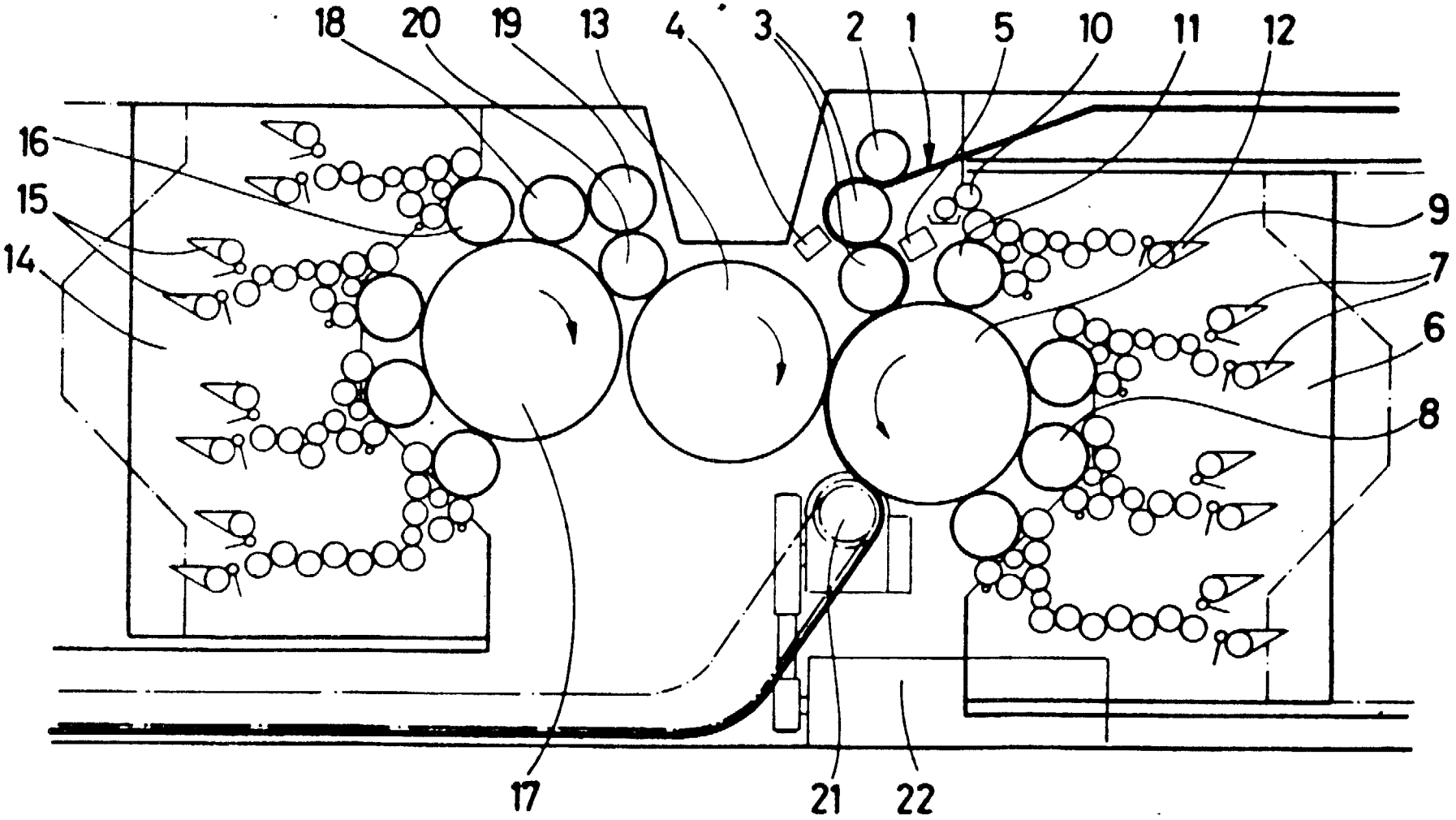

In the example of FIG. 2 the printing according to the "Orlof" method is completed by a wet offset printing also performed when the paper passes between blanket cylinders 12 and 13, which also serves notably for printing a monochrome main design of currency paper. The wet offset unit comprises an intaglio plate cylinder 23 provided with an inking unit 24 and a dampening device 25, both known per se, this intaglio plate cylinder 23 cooperating with blanket cylinder 13 that transfers the image to the paper. Therefore, in this case there is obtained in a single pass on the front side a complete printing for example the four-color safety background by printing according to the "Orlof" method and the monochrome main design by printing according to the wet offset method, whereas the back side receives the four color safety background by an offset printing or a three-color background and also a monochrome main design by wet offset printing.

The above described machine can be used without any difficulty as a web printing machine by simply replacing the sheet conveyor means with means for conveying a web of paper passing between blanket cylinders 12 and 13.

What is claimed is:

1. Rotary multicolor printing machine for the simultaneous printing of both sides of a paper in web or sheet form, more particularly for printing the safety background of fiduciary documents, which comprises a first blanket cylinder contacting a plurality of offset plate cylinders each inked by an inking device in a different color the number of said offset plate cylinders corresponding to the number of colors and designs of the first image to be printed on one side of the paper, said first image consisting of superposed colors and designs, and comprising a second blanket cylinder operating as a color collecting cylinder contacting a plurality of selective color inking cylinders and a typographic plate cylinder, said typographic plate representing the complete design of the second image to be printed on the other side of the paper, said selective color inking cylinders, of which the number corresponds to the number of colors of said second image and wherein the relief areas correspond to the portions of this image to be colored in the different colors, being each inked by an inking unit in a different color and applying an image with juxtaposed colors to said collecting cylinder inking in turn said typographic plate cylinder, a third blanket cylinder, contacting said typographic plate cylinder and receiving therefrom the image with juxtaposed colors, being pressed against said first blanket cylinder, said paper passing between said first and third blanket cylinders so as to be printed simultaneously on both sides with said first and second images respectively further comprising an offset printing unit, of which the plate cylinder contacts the third blanket cylinder, for printing a main monochrome design.

2. Machine according to claim 1, characterized by the fact that at least one of said offset plate cylinders carries a wet offset printing plate with which a dampening device is associated, whereas the other offset plate cylinders carry dry offset printing plates.

3. Machine according to claim 1 , characterized by the fact that a double inking is provided for the typographic plate cylinder by means of two image transfer cylinders.

* * * * *

UNITED STATES PATENT AND TRADEMARK OFFICE

CERTIFICATE OF CORRECTION

PATENT NO. : 4,574,696

DATED : March 11, 1986

INVENTOR(S) : Gualtiero Giori

It is certified that error appears in the above-identified patent and that said Letters Patent is hereby corrected as shown below:

Figure 1 should appear as shown on the attached sheet.

Signed and Sealed this

*Second* Day of *September 1986*

[SEAL]

*Attest:*

DONALD J. QUIGG

*Attesting Officer*

*Commissioner of Patents and Trademarks*

Gualtiero Giori